United States Patent [19]

Olson

[11] 4,238,004

[45] Dec. 9, 1980

[54] HIDDEN CHAIN ASSEMBLY FOR LIFT TRUCK MAST

[75] Inventor: Harlan D. Olson, Sandy, Oreg.

[73] Assignee: Cascade Corporation, Portland, Oreg.

[21] Appl. No.: 58,561

[22] Filed: Jul. 18, 1979

[51] Int. Cl.[3] ..... B66B 9/20

[52] U.S. Cl. ..... 187/9 E; 414/629

[58] Field of Search ..... 187/9 R, 9 E, 95; 414/631, 628, 629, 641; 74/501 R; 403/187, 291; 59/93

[56] References Cited

U.S. PATENT DOCUMENTS

| | | | |
|---|---|---|---|
| 4,009,765 | 3/1977 | Leskovec et al. | 187/9 E |
| 4,051,970 | 10/1977 | Ramsey | 187/9 E |

*Primary Examiner*—Robert J. Spar
*Assistant Examiner*—Kenneth Noland
*Attorney, Agent, or Firm*—Chernoff & Vilhauer

[57] ABSTRACT

A hidden chain assembly adaptable for use in multi-stage telescopic masts for lift trucks. A lifting chain is positioned transversely between two juxtaposed elongate upright members within an elongate enclosure defined by transversely-extending longitudinal flanges of the upright members. The chain is connected to one of the upright members by an anchor located within the enclosure adjacent to one end of the upright member, and extends from the anchor through the enclosure longitudinally toward the opposite end of the upright member where it is trained about a sheave rotatably attached to the other upright member. The anchor includes a detachment structure which is operatively accessible while the anchor is within the enclosure for permitting detachment of the chain from the first upright member despite the hidden location of the anchor within the enclosure. This permits removal, for servicing or replacement, of the chain while the mast is in a fully-retracted position without requiring disassembly of the mast sections from each other. A detachable mast guide roller, and detachable interference stop for preventing hyperextension of the mast sections with respect to each other, are associated with the detachable chain anchor.

9 Claims, 5 Drawing Figures

HIDDEN CHAIN ASSEMBLY FOR LIFT TRUCK MAST

BACKGROUND OF THE INVENTION

This invention relates to improvements in lifting chain assemblies for multistage telescopic lift truck masts. More particularly the invention relates to improvements in "hidden" chain assemblies to facilitate removal, for servicing and replacement, of the lifting chains without requiring disassembly of the mast sections, and to related interference stop structures for preventing hyperextension of the mast sections with respect to one another.

As the usage of highly extensible lift truck masts, particularly of the three and four-stage type, has increased in the materials handling industry, and as the emphasis on improved visibility and maximum load-carrying capacity of the lift trucks has simultaneously increased, various design features have been sought for improving the compactness of such masts. One such design feature has been the location of lifting chains, particularly those used in the telescopic extension of mast sections, within the elongate enclosures normally existing between adjacent mast upright members bounded longitudinally by the transversely-extending longitudinal strengthening flanges typical of such upright members having channel-shaped and I-beam-shaped cross sections. For example, a three-stage mast has previously been devised wherein each of a pair of lifting chains is located within a respective enclosure between adjacent upright members of the outer (i.e. fixed) and intermediate mast sections. Each chain is anchored to the outer upright member by a chain anchor located within the enclosure adjacent the top thereof from which the chain depends downwardly through the enclosure, being trained beneath a sheave rotatably mounted upon the intermediate upright member also within the enclosure. From the sheave the chain extends upwardly and is connected by a second chain anchor to the bottom of a respective inner upright member. In operation, extension of the inner mast section relative to the intermediate mast section exerts a lifting force through each chain on the respective sheaves and thereby simultaneously extends the intermediate mast section with respect to the outer mast section. It will be appreciated that such hidden chain assemblies are very useful in facilitating compact design of the mast since such chains occupy interior spaces which are already present, rather than requiring additional space exterior of the mast sections which would increase the bulk of the overall mast assembly.

A salient problem of such hidden lift chains is their inaccessibility for servicing or replacement due to the position of each chain and at least one of its chain anchors within the aforementioned enclosure. Even access to the interior of the enclosure through the top or bottom thereof is normally obstructed by mast guide rollers. Modern mast design requires the use of such mast guide rollers located within the enclosures between adjacent upright members for engaging the transversely-extending flanges thereof and resisting bending moments while facilitating relative longitudinal movement between the upright members. Normally a pair of cooperating guide rollers are mounted between adjacent upright members, one being fixed to the outer, or lower, upright member adjacent the top thereof and the other being fixed to the inner, or higher, upright member adjacent the bottom thereof. The presence of these guide rollers dictates that those hidden chain anchors positioned within the enclosures between the adjacent upright members be separated from the ends of the enclosures by one of the mast guide rollers. Thus the chain anchor is totally inaccessible and, in order to disconnect the chain therefrom, it has been necessary to disassemble the mast sections from one another so as to gain access to the enclosure to detach the chain. This necessitates a large amount of labor and down time for the lift truck, adding to the cost of its maintenance and reducing its productivity.

A further problem with masts having such hidden chain assemblies is the inability to provide effective interference stops in the enclosure occupied by the hidden chain for preventing inadvertent hyperextension of one mast section with respect to the other. Such stop, to be effective, can be installed only after the two mast sections have been assembled with respect to one another, and must be removable prior to disassembly of the mast sections. The enclosed position of such a stop, and the presence of the guide rollers and hidden chain assembly, would prevent access to permit such installation or removal.

SUMMARY OF THE PRESENT INVENTION

The present invention solves the aforementioned problems of prior art hidden chain assemblies by providing a chain anchor within the enclosure, between adjacent upright members, which includes a detachment structure operatively accessible while the anchor is within the enclosure for permitting detachment of the chain from the respective upright member despite the location of the anchor within the enclosure. To provide such access, the mast guide roller which is positioned between the chain anchor and the nearest end of the enclosure is detachable from its respective upright member without requiring any disassembly of the adjacent upright members from each other so that, upon removal of the detachable guide roller, the detachment structure of the chain anchor is accessible through the end of the enclosure. This combination of features is adaptable for use with hidden chain structures in masts having any number of extensible mast sections and, although preferably utilized in a situation where the detachable chain anchor is located near the top of an enclosure and the chain extends downwardly therefrom toward a sheave adjacent the bottom of the enclosure, could alternatively be used in the opposite situation wherein the detachable chain anchor is near the bottom of the enclosure and the hidden chain extends upwardly therefrom through the enclosure.

The chain anchor, when mounted near the top of an enclosure, is preferably detachably mounted upon an interference block connected to the lower upright member, such interference block acting as a stop to limit the upward travel of the chain sheave mounted at the bottom of the adjacent higher upright member so as to prevent hyperextension thereof. The interference block is mounted to the lower upright member within the enclosure by a detachable mounting structure permitting installation and removal of the block while the adjacent upright members are assembled so that the block interferes with neither the initial assembly nor subsequent disassembly of the upright members. The detachable mounting of the chain anchor upon the interference block ensures that the mast cannot operatively be reassembled after servicing without the installation of the interference block.

The foregoing and other objectives, features and advantages of the present invention will be more readily understood upon consideration of the following detailed description of the invention taken in conjunction with the accompanying drawings.

DETAILED DESCRIPTION OF THE PREFERRED EMBODIMENT

Figure 1:
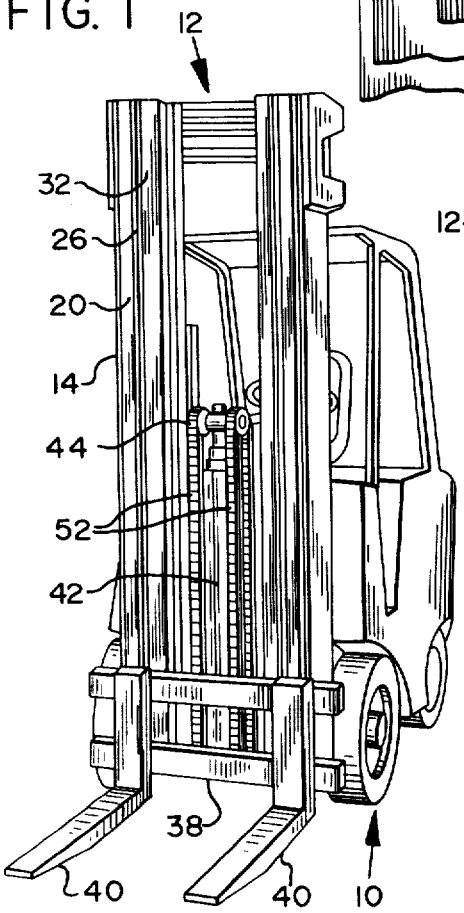
FIG. 1 is a perspective view of a lift truck showing a four-stage mast constructed in accordance with the present invention mounted thereon.

FIG. 1 depicts a lift truck, generally indicated as 10, having a four-stage extensible-contractable telescopic mast 12 mounted on the front thereof. The structural and operational features of the four-stage mast 12 are not a part of the present invention and the mast is shown merely as an exemplary application of the hidden chain assembly, it being understood that the hidden chain assembly of the present invention is usuable as well in other types of multistage masts, such as three-stage masts, and in other lift chain arrangements which may result in reversal, or turning upside down, of the hidden chain assembly depicted herein, all of such variations being within the scope of the present invention.

Figure 3:
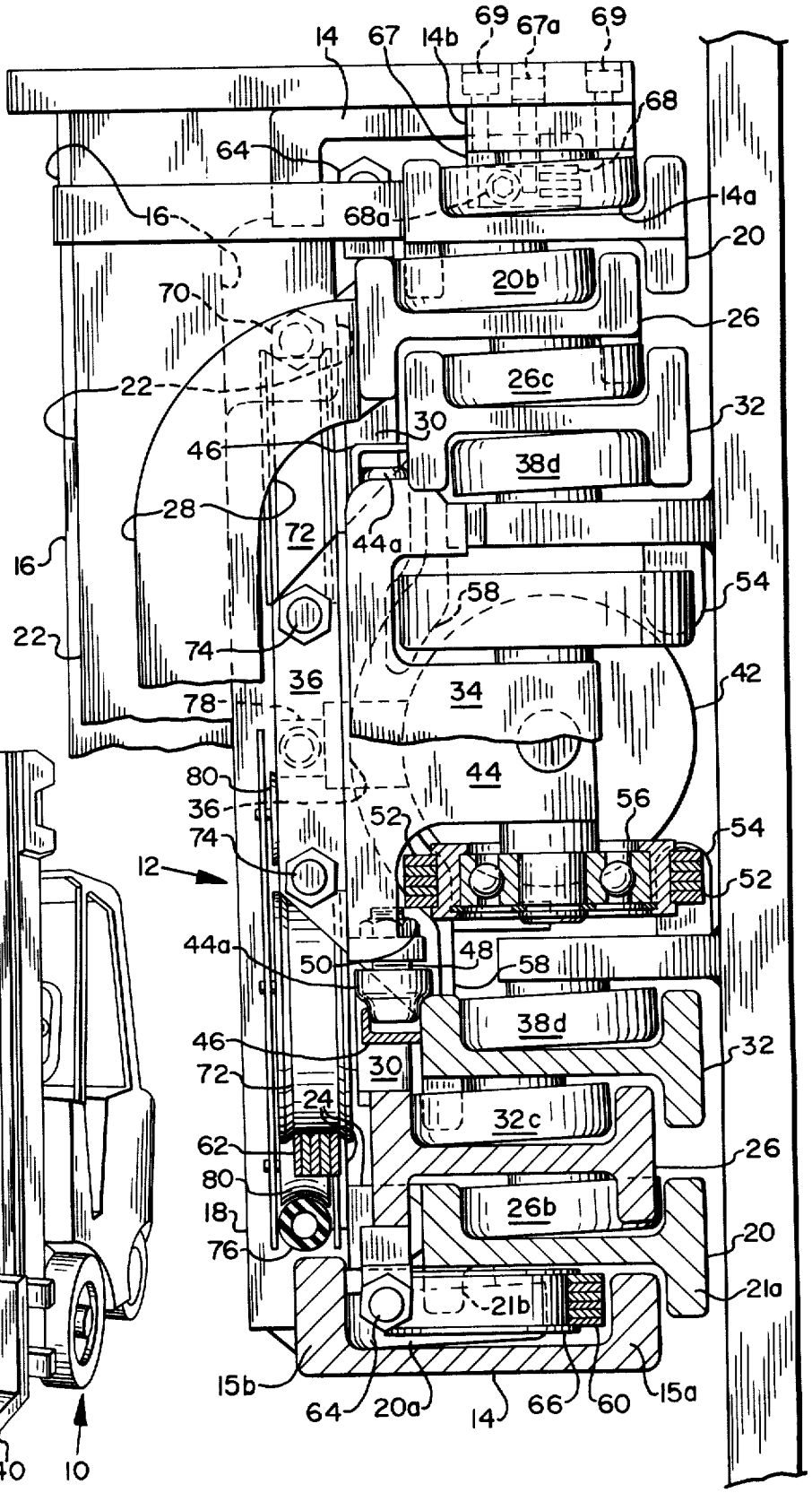
FIG. 3 is a partially sectional view taken along line 3—3 of FIG. 2.
Figure 2:
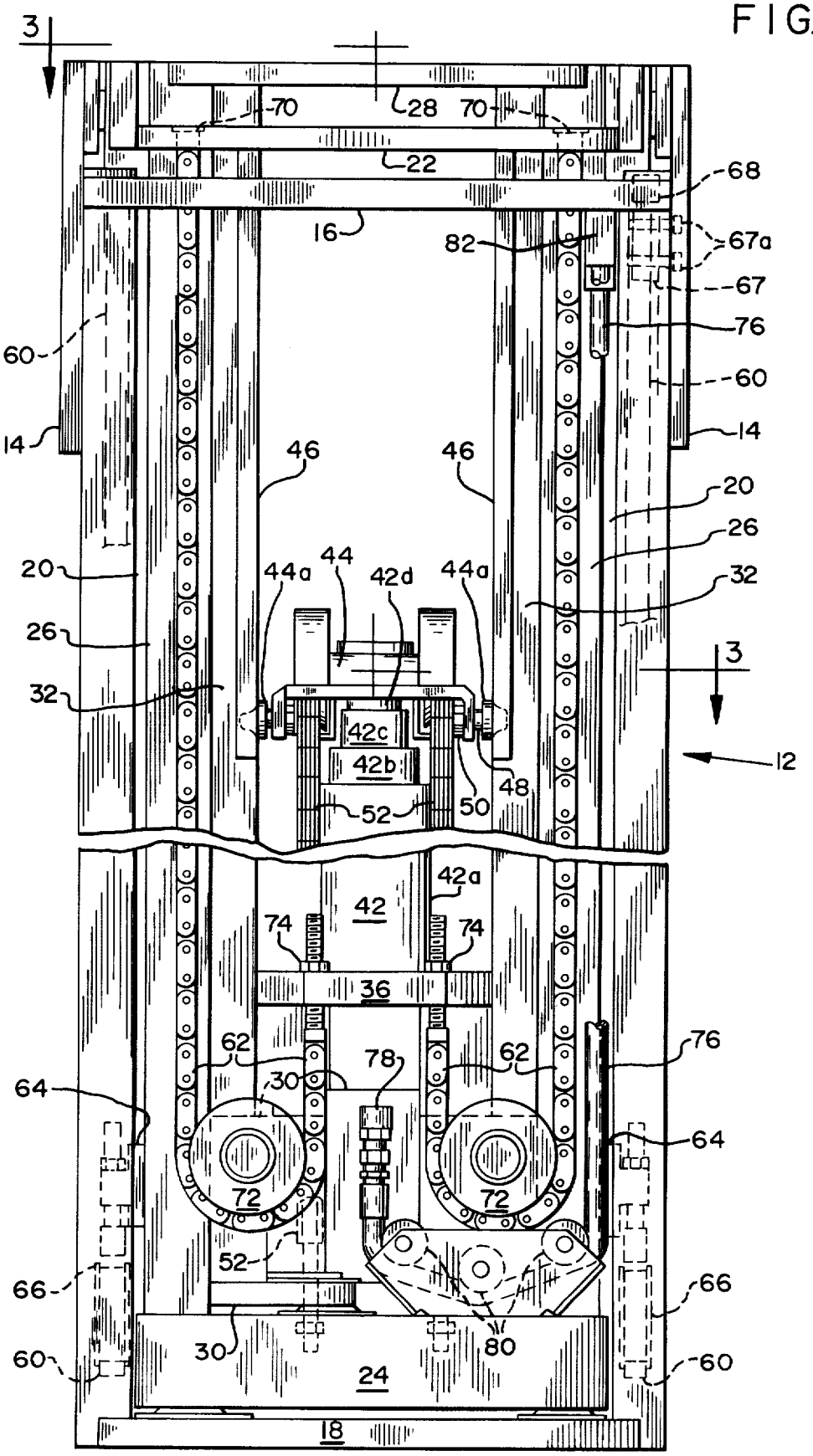
FIG. 2 is a simplified extended rear view of such four-stage mast.
Figure 4:
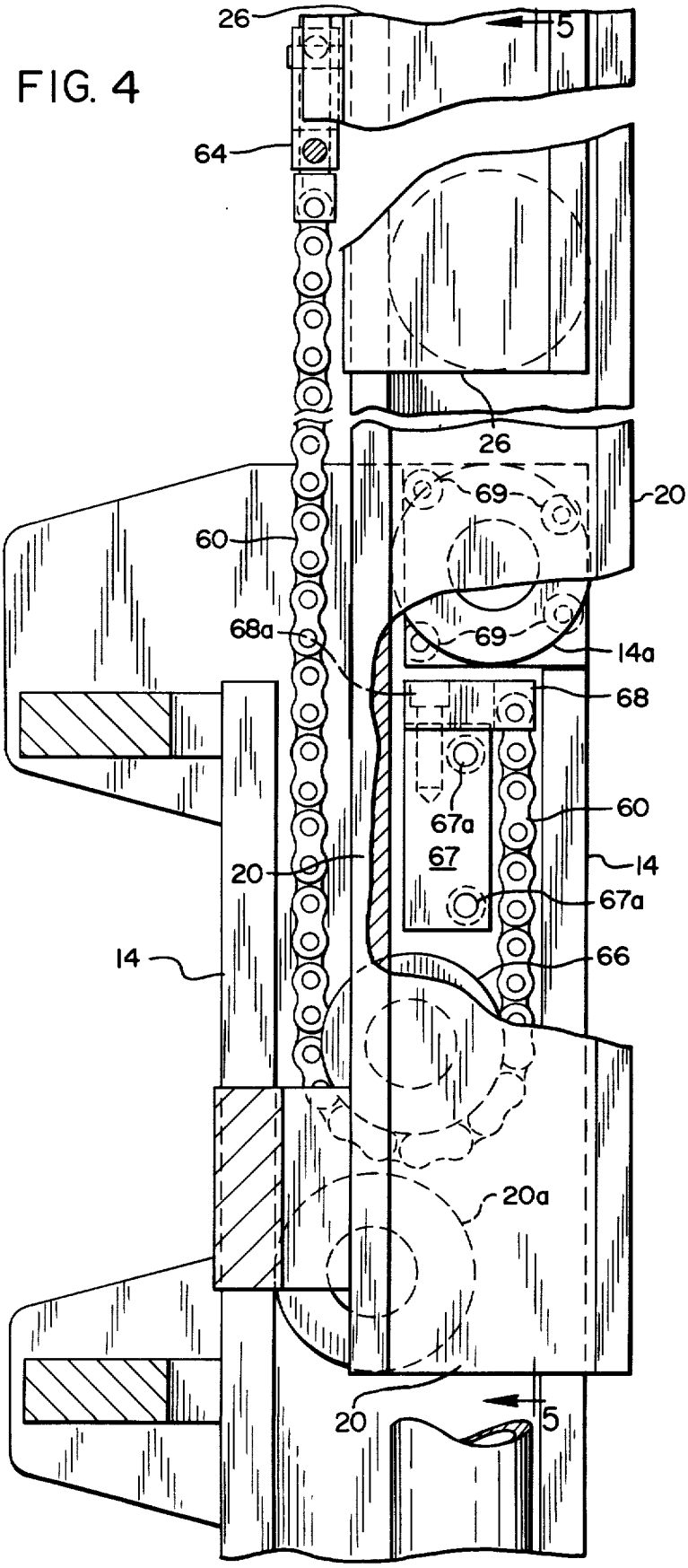
FIG. 4 is a partially sectional, extended interior view of the four-stage mast of FIGS. 2 and 3 with portions broken away to show inner structure.
Figure 5:
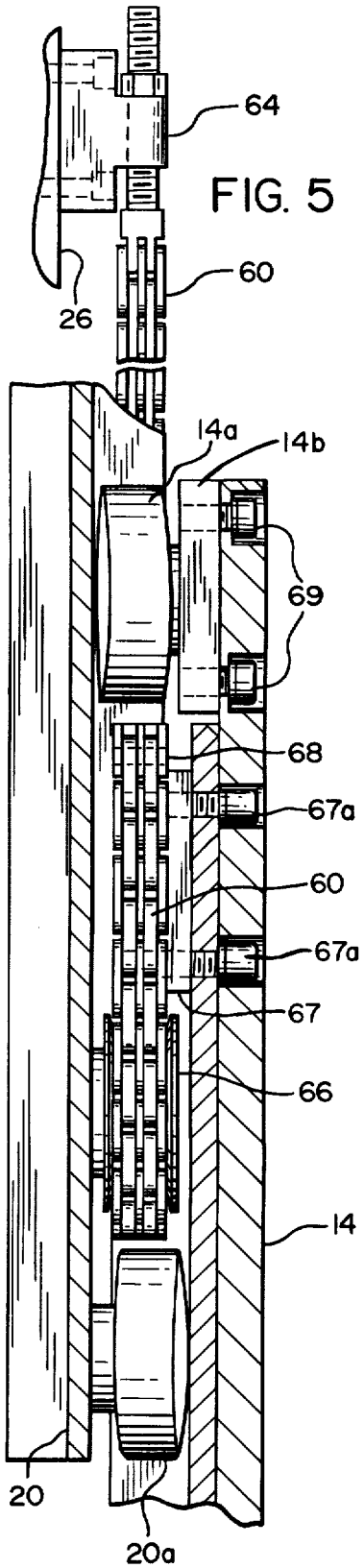
FIG. 5 is a sectional front view taken along line 5—5 of FIG. 4 with portions broken away.

So that the general environment of the hidden chain assembly will be better understood, the salient features of the exemplary mast 12 will be described. With reference also to FIGS. 2 and 3, the mast 12 consists of multiple relatively reciprocable mast sections comprising an outer mast composed of a pair of transversely-spaced, inwardly-facing upright channel members 14 joined together at their tops by a cross member 16 and at their bottoms by a cross member 18. Spaced transversely inwardly from the upright members 14 are a pair of I-beam-shaped upright members 20 interconnected by a cross member 22 at their tops and by a cross member 24 at their bottoms which form the outer intermediate mast section. The upright members 20 are offset forwardly of the upright members 14 and, when the mast is contracted, each adjacent pair of upright members 14 and 20 are juxtaposed with each other in a fashion whereby the transversely-extending strengthening flanges 15*a* and 15*b* of the respective upright member 14 transversely overlap the strengthening flanges 21*a* and 21*b* *L of the juxtaposed upright member 20, such flanges thereby defining an elongate enclosure between the upright members bounded longitudinally by the transversely overlapping strengthening flanges and extending between the rearward edge of flange 15a* and the forward edge of flange 21*b*.

An outwardly-facing bottom guide roller 20*a* is rotatably mounted upon each of the upright members 20 of the outer intermediate mast section, extending through a cutout in the respective rear flange 21*b* of the upright member 20 and engaging the rear, inwardly-extending flange 15*b* of the juxtaposed outer mast upright member 14. Also, an inwardly-facing top guide roller 14*a* is rotatably mounted upon each of the outer mast upright members 14 and engages the rear flange 21*b* of the respective juxtaposed upright member 20. These rollers permit longitudinal extension of the outer intermediate mast section with respect to the outer mast section while also resisting the normal bending moments imposed on the mast by the load.

An inner intermediate mast section composed of I-beam-shaped upright members 26 interconnected at their tops by cross member 28, and at their bottoms by cross member 30, is positioned between the upright members 20 of the outer intermediate mast section. An outwardly-facing bottom roller 26*b* rotatably mounted to each upright member 26 engages a rear strengthening flange of the adjacent upright member 20, while an inwardly-facing top roller 20*b* rotatably mounted upon each upright member 20 engages a rear strengthening flange of a respective adjacent upright member 26 to permit longitudinal extension of the inner intermediate mast section with respect to the outer intermediate mast section in a manner similar to that previously described with respect to rollers 14*a* and 20*a*.

An inner mast section composed of a pair of I-beam-shaped upright members 32 joined together at their tops by an upper cross member 34 and at their bottoms by a lower cross member 36 is mounted transversely between the upright members 26 of the inner intermediate mast section. Each upright member 32 has an outwardly-facing bottom roller 32*c* mounted rotatably thereon which, in cooperation with a respective inwardly-facing top roller 26*c* mounted upon each upright member 26 of the inner intermediate mast section, permits longitudinal movement of the inner mast section with respect to the inner intermediate mast section in a manner similar to that described with respect to cooperating rollers 14*a* and 20*a*.

Mounted upon the upright members 32 of the inner mast section for vertical movement with respect thereto is a load carriage 38 having upper and lower transversely-spaced pairs of rollers 38*d* respectively engaging the inwardly-facing channels of the upright members 32. The load carriage 38 extends forwardly from the inner mast section and has load-handling implements such as forks 40 (FIG. 1), clamp arms or similar load-handling devices mounted thereon.

A fluid-actuated, extensible-contractable fluid ram assembly 42 has a base portion 42*a* supportably mounted upon the lower cross member 30 of the inner intermediate mast section such that the ram assembly 42 moves in unison therewith. Three relatively reciprocable ram portions 42*b*, 42*c* and 42*d* respectively are extensible from the base portion 42*a*, the ram portion 42*d* having an upper end terminating in a cross head 44 which is more extensible in a longitudinal direction than the upper ends of the other ram portions 42*b* and 42*c*. The cross head 44 is longitudinally movable and guidable with respect to the upright members 32 of the inner mast section by means of transversely-spaced roller 44*a* which ride vertically in inwardly-facing longitudinal channels 46 mounted on the upright members 32. Each roller 44*a* is rotatably mounted to the cross head 44 on a shaft 48 which is threaded into the cross head 44, thereby permitting transverse adjustment of the rollers 44*a*. A lock nut 50 retains each threaded shaft 48 in its adjusted position.

Elevation of the load carriage and extension of the mast assembly are accomplished through the extension of the ram assembly 42 and the cooperation of three pairs or sets of load-lifting flexible tension members, usually chains. Chains 52 are connected at one end to a respective chain anchor 54 on the carriage 38 from which they extend upwardly and are trained over a pair of sheaves 56 rotatably mounted on the cross head 44, and then extend downwardly toward a respective chain anchor 58 fixed to a respective one of the inner mast section upright members 32 adjacent its bottom.

Two further pairs of load-lifting chains 60 and 62 respectively are provided, pair 60 serving to extend the outer intermediate mast section with respect to the outer mast section, and pair 62 serving to extend the inner intermediate mast section with respect to the outer intermediate mast section. Each of the pair of chains 62 has one of its ends connected to the upper cross member 22 of the outer intermediate mast section at a respective chain anchor 70 from which it depends downwardly and is trained beneath a respective rearwardly-facing sheave 72 rotatably mounted on the lower cross member 30 extending transversely between the rear portions of the upright members 26 of the inner intermediate mast section so as to rotate about an axis extending from front to rear. From the sheave 72 the respective chain 62 extends upwardly to a respective chain anchor 74 connected to the cross member 36 of the inner mast section.

Each of the other pair of chains 60 is part of the hidden chain assembly to which the present invention is directed. Each chain 60 is connected to the rearwardly-protruding rear portion of one of the respective upright members 26 of the inner intermediate mast section by a transversely-extending chain anchor 64 which extends from the bottom of the respective upright member 26 outwardly toward the outer upright member 14 bypassing the rear edge of the upright member 20. One end of each chain 60 depends from a respective chain anchor 64 and is trained beneath a respective sheave 66 rotatably mounted on each upright member 20 so as to rotate about a transverse axis. From the respective sheave 66, each chain 60 extends upwardly through the elongate enclosure formed between the juxtaposed upright members 14 and 20 bounded longitudinally by the transversely-extending strengthening flanges of the respective upright members. Each chain 60 ultimately connects to an upright member 14 of the outer mast section at an upper chain anchor 68 fixed to the interior of the respective upright member 14 within the elongate enclosure adjacent its top. The chain anchors 68 will be discussed hereafter in greater detail.

Inasmuch as the base portion **42*a* of the ram assembly is mounted on the inner intermediate mast section and thereby moves upwardly in unison therewith during mast extension, a flexible hydraulic conduit 76 is provided connected at one end by a fitting 78 to the base portion 42*a* of the ram assembly and depending therefrom to a series of transversely-spaced sheaves 80 mounted on the lower cross member 24 of the outer intermediate mast section so as to rotate about axes extending from front to rear. The conduit 76 is trained under the sheaves 80 from which it extends upwardly toward the upper cross member 16 of the outer mast section to which it is attached by a bracket 82. From its point of attachment to the cross head 16, it depends downwardly toward the lift truck 10** where it is coupled in a conventional manner to the lift truck's hydraulic system (not shown).

Upon the introduction of pressurized fluid into the ram assembly through the conduit 76, the ram begins extending to initiate the initial, or free lift, portion of upward travel of load carriage 38 whereby the chains 52 lift the load carriage 38. The initial portion of load carriage elevation continues until the load carriage reaches substantially the top of the inner mast section and cross head 44 contacts cross member 34 of the inner mast section. From this point further extension of the ram assembly causes simultaneous extension of each mast section, except for the outer mast section, from the next lower mast section by the action of chains 60 and 62. Thus, by virtue of the contact between the cross head 44 and the cross member 34 of the inner mast section, the ram assembly extends the inner mast upright members 32 from the inner intermediate mast upright members 26. This extension in turn exerts tension on chains 62 which exert a lifting force on the inner intermediate upright members 26 through sheaves 72 and extend the inner intermediate upright members 26 from the outer intermediate upright members 20. The latter extension in turn exerts tension on chains 60 which exert a lifting force on outer intermediate upright members 20 through sheaves 66, thereby extending outer intermediate upright members 20 from outer upright members 14.

Each chain anchor 68 of the hidden chain assembly comprising chains 60 is detachably fixed to the interior of the respective upright member 14 by a bolt **68*a* which is operatively accessible while the anchor 68 is within the elongate enclosure between the upright members 14 and 20. The bolt 68*a* permits detachment and reattachment of the end of the chain with respect to the upright member 14 while the respective upright members 14 and 20 are juxtaposed with respect to each other in a contracted condition despite the location of the anchor within the enclosure. Access to the bolt 68*a* through the top of the enclosure is provided by a removable mounting of the respective guide roller 14*a* located above the chain anchor 68. The roller 14*a* is rotatably mounted upon a plate 14*b* which is in turn detachably fixed to the interior of the outer upright member 14 by means of bolts 69 accessible from the exterior of the mast for permitting detachment and reattachment of the plate 14*b* and roller 14*a* with respect to the upright member 14 while the upright members 14 and 20 are juxtaposed with respect to each other in a fully-collapsed position. With the roller 14*a* removed, the bolt 68*a* is accessible through the top of the enclosure and can be removed, thereby freeing the end of the chain 60 and permitting the chain, after detachment of its other end from the easily accessible chain anchor 64, to be pulled upwardly out of the top of the enclosure. Replacement of the chain merely involves the opposite procedure, i.e. lowering of the chain through the enclosure, reattaching the chain anchor 68 by means of the bolt 68*a* and reattaching the guide roller 14*a* by means of the externally accessible bolts 69. The chain 60 is pulled beneath the sheave 66 and reattached at its other end to the chain anchor 64**.

The member which supports the chain anchor 68 and into which the bolt **68*a* is threaded comprises an interference block 67 which prevents inadvertent hyperextension of the upright member 20 with respect to the upright member 14 by blocking and thereby limiting the upward travel of the sheave 66. The function of the interference block 67 dictates that it be installed after assembly of the upright members 14 and 20, and that it be removed prior to any disassembly thereof. This is accomplished by detachably mounting the interference block 67 upon the respective upright member 14 by a detachment structure, comprising bolts 67***a*, operatively accessible from the exterior of the mast for permitting detachment and reattachment of the interference block 67, and by providing the abovedescribed removable mounting of guide roller 14*a* above the interference block 67 such that the block may be inserted into, or removed from, the enclosure while the upright members are juxtaposed in an assembled, contracted relationship with respect to each other.

It will be appreciated that, although the movable chain anchor 68 and removable interference block 67 need not necessarily be integrated with one another as shown, there are several salient advantages in doing so. Aside from the convenience of removing the two as a unit by detachment of bolts 67*a* when it is desired to disassemble the mast rather than merely service the chain 60, the dependence of the chain anchor 68 upon the interference block 67 for its support prevents operative assembly of the mast without installation of the interference block 67, thereby preventing any chance of inadvertent failure to install the interference block.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-lifting structure for an industrial lift truck or the like comprising:

(a) a telescopic mast comprising multiple relatively reciprocable mast sections having respective elongate upright members longitudinally extensible and contractable with respect to each other and, when said upright members are contracted, juxtaposed with each other in spaced, transverse relation, said juxtaposed upright members having elongate, transversely-extending flange means for strengthening said upright members, said flange means defining an elongate enclosure between said juxtaposed upright members bounded longitudinally by said flange means;

(b) a flexible tension member having one end connected to a first one of said juxtaposed upright members by an anchor located within said enclosure adjacent one end of said first upright member, and extending from said anchor through said enclosure longitudinally toward the opposite end of said first upright member;

(c) a sheave rotatably mounted on the other one of said juxtaposed upright members and positioned transversely between said upright members, said flexible tension member being trained around said sheave;

(d) said anchor including detachment means operatively accessible while said anchor is within said enclosure for permitting detachment and reattachment of said flexible tension member with respect to said first upright member while said upright members are juxtaposed with respect to each other.

2. The load-lifting structure of claim 1 wherein said detachment means is operatively accessible from said one end of said first upright member.

3. The load-lifting structure of claim 2, further including roller means for engaging said flange means rotatably mounted upon said first upright member at a position transversely between said juxtaposed upright members and longitudinally between said anchor and said one end of said first upright member, and means detachably mounting said roller means to said first upright member for permitting detachment and reattachment of said roller means with respect to said first upright member while said upright members are juxtaposed with respect to each other and thereby permitting access to said detachment means from said one end of said first upright member.

4. The load-lifting structure of claim 1, further including stop means mounted upon said first upright member within said enclosure at a position interfering with and thereby limiting relative longitudinal motion between said sheave and said first upright member, and second detachment means operatively accessible while said stop means is within said enclosure for permitting detachment and reattachment of said stop means with respect to said first upright member while said upright members are juxtaposed with respect to each other.

5. The load-lifting structure of claim 4 wherein said anchor is supportably mounted upon said stop means.

6. The load-lifting structure of claim 5 wherein said anchor is detachably connected to said stop means.

7. A load-lifting structure for an industrial lift truck or the like comprising:

(a) a telescopic mast comprising multiple relatively reciprocable mast sections having respective elongate upright members longitudinally extensible and contractable with respect to each other and, when said upright members are contracted, juxtaposed with each other in spaced, transverse relation, said juxtaposed upright members having elongate, transversely-extending flange means for strengthening said upright members, said flange means defining an elongate enclosure between said juxtaposed upright members bounded longitudinally by said flange means;

(b) a flexible tension member having one end connected to a first one of said juxtaposed upright members by an anchor adjacent one end of said first upright member, and extending from said anchor through said enclosure longitudinally toward the opposite end of said first upright member;

(c) a sheave rotatably mounted on the other one of said juxtaposed upright members and positioned transversely between said upright members, said flexible tension member being trained around said sheave;

(d) stop means mounted upon said first upright member within said enclosure at a position interfering with and thereby limiting relative longitudinal motion between said sheave and said first upright member and thereby limiting longitudinal extension of said upright members with respect to each other; and (e) detachment means operatively accessible while said stop means is within said enclosure for permitting detachment and reattachment of said stop means with respect to said first upright member while said upright members are juxtaposed with respect to each other.

8. The load-lifting structure of claim 7 wherein said stop means is mounted adjacent one end of said first upright member, further including roller means for engaging said flange means rotatably mounted upon said first upright member at a position transversely between said juxtaposed upright members and longitudinally between said stop means and said one end of said first upright member, and means detachably mounting said roller means to said first upright member for permitting detachment and reattachment of said roller means with respect to said first upright member while said upright members are juxtaposed with respect to each other and thereby permitting removal of said stop means from said enclosure at said one end of said first upright member.

9. A load-lifting structure for an industrial lift truck or the like comprising:

(a) a telescopic mast comprising multiple relatively reciprocable mast sections having respective elongate upright members longitudinally extensible and contractable with respect to each other and, when said upright members are contracted, juxtaposed with each other in spaced, transverse relation, said juxtaposed upright members having elongate, transversely-extending flange means for strengthening said upright members, said flange means defining an elongate enclosure between said juxtaposed upright members bounded longitudinally by said flange means;

(b) stop means mounted upon said first upright member within said enclosure adjacent one end of said first upright member for limiting longitudinal extension of said upright members with respect to each other;

(c) detachment means operatively accessible while said stop means is within said enclosure for permitting detachment and reattachment of said stop means with respect to said first upright member while said upright members are juxtaposed with respect to each other;

(d) roller means for engaging said flange means rotatably mounted upon said first upright member at a position transversely between said juxtaposed upright members and longitudinally between said stop means and said one end of said first upright member; and (e) means detachably mounting said roller means to said first upright member for permitting detachment and reattachment of said roller means with respect to said first upright member while said upright members are juxtaposed with respect to each other and thereby permitting removal of said stop means from said enclosure at said one end of said first upright member.

* * * * *